US007305778B2

(12) United States Patent
Wakitani et al.

(10) Patent No.: US 7,305,778 B2
(45) Date of Patent: Dec. 11, 2007

(54) SELF-PROPELLED WORKING MACHINE

(75) Inventors: Tsutomu Wakitani, Wako (JP); Norikazu Shimizu, Wako (JP); Toshiaki Kawakami, Wako (JP)

(73) Assignee: Honda Motor Co., Ltd. (JP)

( * ) Notice: Subject to any disclaimer, the term of this patent is extended or adjusted under 35 U.S.C. 154(b) by 390 days.

(21) Appl. No.: 10/980,524

(22) Filed: Nov. 3, 2004

(65) Prior Publication Data

US 2005/0097788 A1 May 12, 2005

(30) Foreign Application Priority Data

Nov. 11, 2003 (JP) ..... 2003-381393

(51) Int. Cl.
*E01H 5/09* (2006.01)

(52) U.S. Cl. ..... 37/245; 37/249; 37/382; 172/3; 172/4.5; 701/50

(58) Field of Classification Search ..... 37/244, 37/245, 246, 249, 257, 348, 382, 414; 172/2, 172/3, 4, 4.5; 56/10.2 R, 10.2 A, 10.2 G, 56/10.2 H, DIG. 15; 701/50; 60/422; 340/684
See application file for complete search history.

(56) References Cited

U.S. PATENT DOCUMENTS 3,028,717 A * 4/1962 West ..... 56/10.5
3,969,875 A * 7/1976 Nofel ..... 56/10.2 R
5,138,824 A * 8/1992 Oshima et al. ..... 56/10.2 R
5,878,557 A * 3/1999 Wyffels et al. ..... 56/13.5
5,957,213 A * 9/1999 Loraas et al. ..... 172/2
5,991,677 A * 11/1999 Kinugawa et al. ..... 701/50
6,550,161 B2 4/2003 Hanafusa et al. ..... 37/246
6,564,481 B2 5/2003 Wakitani et al. ..... 37/348
6,612,966 B2 * 9/2003 Fischer et al. ..... 477/93
7,007,446 B2 * 3/2006 Dettmann ..... 56/11.9

FOREIGN PATENT DOCUMENTS

DE 10242368 4/2003
JP 00080621 3/2000
JP 01271317 10/2001

* cited by examiner

*Primary Examiner*—Thomas B. Will
*Assistant Examiner*—Joel F Mitchell
(74) *Attorney, Agent, or Firm*—Adma & Wilks

(57) ABSTRACT

A self-propelled working machine has a pair of transporting parts, a working part, an engine for driving at least the working part, and a main switch for turning the engine on and off. A locomotion preparation switch produces a command for moving the transporting parts when turned on and produces a stop command for stopping movement of the transporting parts when turned off. A locomotion speed setting member orders a target locomotion speed of the transporting parts. A work switch switches the working part on and off. A control part stops the engine when a first condition that the main switch is on, a second condition that the locomotion preparation switch is off, a third condition that the transporting parts have stopped moving and the target locomotion speed ordered by the locomotion speed setting member is zero, and a fourth condition that the work switch is off, are satisfied.

20 Claims, 11 Drawing Sheets

A3
ST15
READ IN SWITCH SIGNALS
ST16
MAIN SWITCH IN ON POSITION ?
NO
YES
ST17
IDLE MODE SWITCH ON ?
NO
YES
END
ST18
LOCOMOTION PREPARATION SWITCH ON ?
NO
YES
ST19
AUGER SWITCH ON ?
NO
YES
ST20
READ IN CONTROL DIRECTION AND CONTROL LEVEL Op OF DIRECTION/SPEED LEVER
ST21
OBTAIN TARGET SPEED So FROM Op
ST22
START ELECTRIC MOTOR
ST23
CONTROL ELECTRIC MOTORS WITH So
A4

SELF-PROPELLED WORKING MACHINE

FIELD OF THE INVENTION

The present invention relates to a self-propelled working machine having a working part driven by motive power from an engine, and particularly to a working machine in which under predetermined conditions the engine is automatically stopped.

BACKGROUND OF THE INVENTION

As a common working machine, a self-propelled snow remover having a snow-removing part as a working part is disclosed for example in JP-A-2000-80621 and JP-A-2001-271317.

A working machine consisting of the snow-remover disclosed in JP-A-2001-271317 will now be described briefly on the basis of FIG. 8 hereof.

Referring to FIG. 8, a working machine 200 has on a machine body 201 a working part 204 made up of an auger 202 and a blower 203; an engine 205 for driving the working part 204; left and right transporting parts 206, 206 consisting of crawlers; left and right electric motors 207, 207 for driving these transporting parts 206, 206; a generator 209, driven by the engine 205, for supplying electrical power to a battery 208 and the electric motors 207, 207; and a control part 211 for controlling the electric motors 207, 207.

Some of the output of the engine 205 is used to drive the generator 209, and the electrical power obtained is supplied to the battery 208 and the left and right electric motors 207, 207. The remainder of the output of the engine 205 is allocated to driving the working part 204 via an electromagnetic clutch 212. Thus, in this snow-remover 200, the working part 204 is driven by the engine 205 and the transporting parts 206, 206 are driven by the electric motors 207, 207.

When a working machine 200 like this is in use, the working part is stopped and started intermittently depending on the working circumstances. For example, in the course of snow-removal work, changing location and removing snow will be stopped from time to time. When working has stopped, the engine 205 is in an idling state, in which there is almost no load on it. From the point of view of saving fuel, improving the working environment, and extending the life of the engine, it is undesirable for the idling state to continue. For this reason, it is common for the operator to stop the engine 205 every time working is interrupted. However, the operation of stopping the engine 205 every time working is interrupted is tiresome.

Therefore, technology has been awaited with which when the working of the working part has been interrupted and the engine is idling, the engine stops automatically.

SUMMARY OF THE INVENTION

The present invention provides a working machine having left and right transporting parts such as wheels or crawlers; a working part; an engine for driving at least the working part; a main switch for turning the engine on and off; a locomotion preparation switch for producing a command for locomotion—enabling the transporting parts when on and producing a stop command when off; a locomotion speed setting member for ordering a target locomotion speed of the left and right transporting parts; a work switch for switching on and off the working part; and a control part for performing control to stop the engine when a first condition that the main switch is on, a second condition that the locomotion preparation switch is off, a third condition that the left and right transporting parts have stopped or the target locomotion speed ordered by the locomotion speed setting member is zero, and a fourth condition that the work switch is off, are satisfied.

Thus, in this invention, by constructing an engine stopping system using constituent parts which are necessary for the working machine anyway, the engine can be stopped automatically. Also, because it is not necessary for the operator to stop the engine every time work is interrupted, the load on the operator is lightened. And by idling of the engine being eliminated as much as possible, fuel is saved, engine exhaust is kept down and the working environment is improved, and the life of the engine can be extended.

Preferably, locomotion is stopped when the actual locomotion speed of the left and right transporting parts is below a preset fixed lower limit threshold value. This lower limit threshold value is a locomotion speed such that the transporting parts are stopped or essentially nearly stopped.

Preferably, a working machine according to the invention also has electric motors for supplying motive power to the transporting parts and a battery for supplying electrical power to the electric motors, and under the above-mentioned fourth condition the control part performs control to stop the engine when a detected voltage of the battery is above a preset lower limit threshold value.

Preferably, after the engine has stopped, among the states where the main switch is on, the locomotion preparation switch is on, and the work switch is on, the control part performs control to restart the engine at least when the locomotion preparation switch is turned on.

BRIEF DESCRIPTION OF THE DRAWINGS

A number of preferred embodiments of the invention will be described below in detail on the basis of the accompanying drawings, in which.

DETAILED DESCRIPTION OF THE PREFERRED EMBODIMENTS

Figure 1:
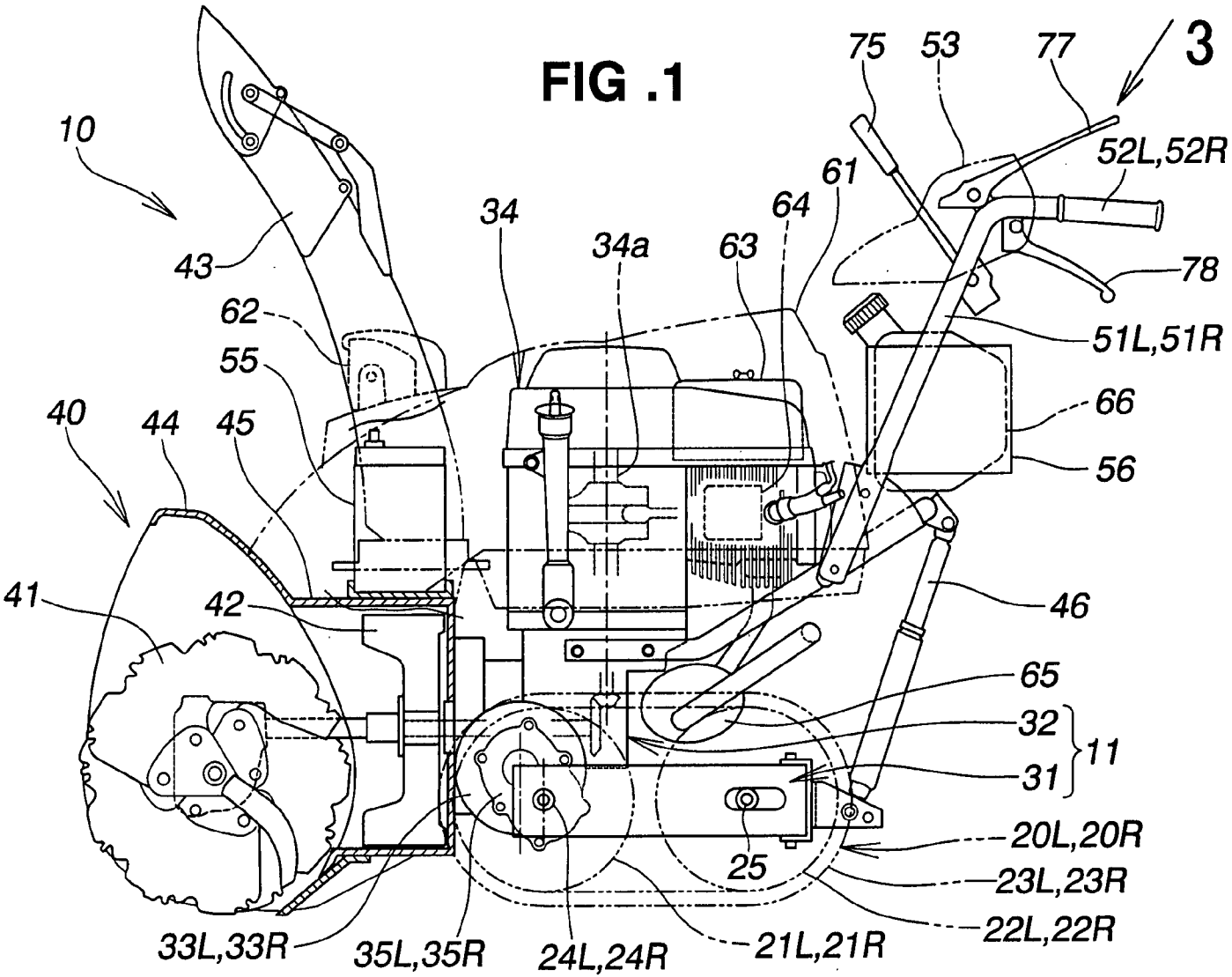
FIG. 1 is a side view of a snow-remover constituting a first preferred embodiment of a working machine according to the invention.

A preferred embodiment of a working machine will now be described, and as a suitable embodiment of a working machine the example of a snow-remover will be used, as shown in the drawings.

Figure 2:
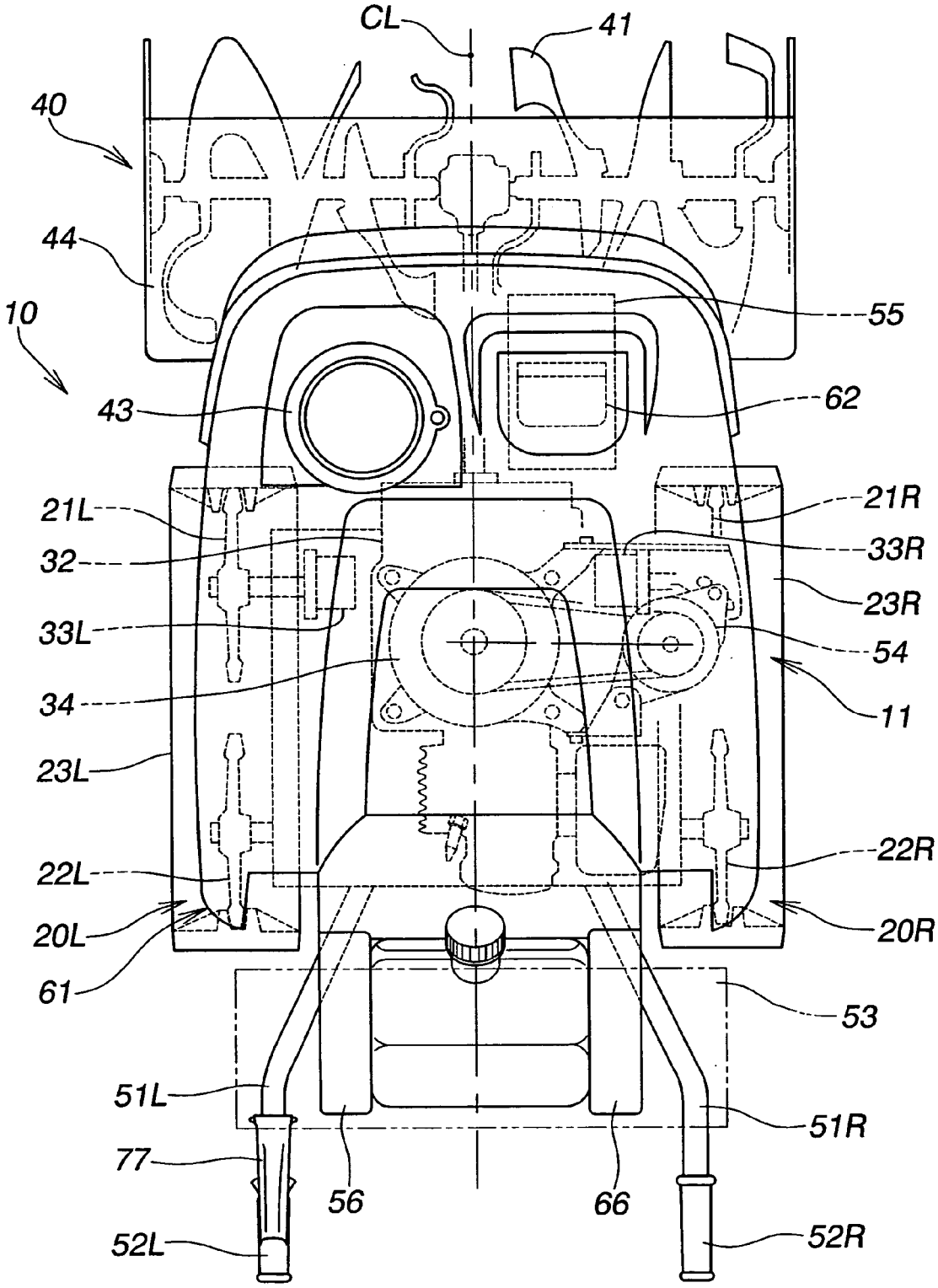
FIG. 2 is a plan view of the snow-remover shown in FIG. 1.

As shown in FIG. 1 and FIG. 2, a snow-remover 10 includes a machine body 11 made up of a transport frame 31 and a transmission case 32.

The transport frame 31 has left and right transporting parts 20L, 20R. The transmission case 32 is attached to the transport frame 31 in such a way that it can swing up and down. Left and right electric motors 33L, 33R are mounted on left and right side parts of the transmission case 32. An engine (internal combustion engine) 34 is mounted on the transmission case 32. A snow-removal working part 40 is mounted on the front of the transmission case 32. Left and right operating handles 51L, 51R extend upward and rearward from the top of the transmission case 32. A control panel 53 is provided between the left and right operating handles 51L, 51R.

The snow-remover 10 is a self-propelled, walking-type working machine whose operator walks behind the control panel 53.

The left and right operating handles 51L, 51R have grips 52L, 52R at their ends to be gripped by hands.

It is a characteristic feature of the snow-remover 10 of this invention that the snow-removal working part 40 is driven by the engine 34 and the transporting parts 20L, 20R are driven by the electric motors 33L, 33R. This approach is adopted on the basis of the idea that for control of locomotion speed, turning control, and forward-reverse switching control, electric motors are preferable, whereas for the working parts, which are subject to sharp load fluctuations, a more powerful internal combustion engine is appropriate.

The left and right electric motors 33L, 33R are drive sources for locomotion, for driving the left and right transporting parts 20L, 20R via left and right transport transmission mechanisms 35L, 35R.

The left transporting part 20L is a crawler having a crawler belt 23L passing around a front driving wheel 21L and a rear driven wheel 22L, and rotates the driving wheel 21L forward and in reverse with the left drive motor 33L.

The right transporting part 20R is a crawler having a crawler belt 23R passing around a front driving wheel 21R and a rear driven wheel 22R, and rotates the driving wheel 21R forward and in reverse with the right electric motor 33R.

The transport frame 31 rotatably supports left and right driving wheel axles 24L, 24R and at its rear end supports a driven wheel axle 25. The left and right driving wheel axles 24L, 24R are rotating shafts to which the left and right driving wheels 21L, 21R are fixed. The driven wheel axle 25 has the left and right driven wheels 22L, 22R rotatably attached to it.

The engine 34 is a vertical engine having a crankshaft 34*a* extending downward, and is a for-working drive source for driving the snow-removal working part 40 by transmitting a driving force thereto via a working-part driving transmission mechanism housed in the transmission case 32.

The snow-removal working part 40 is made up of an auger 41 at the front, a blower 42 at the rear, a shooter 43 at the top, an auger housing 44 covering the auger 41, and a blower housing 45 covering the blower 42. The auger 41 has an action of collecting snow piled on the ground to the center. The blower 42 receives this snow and blows the snow through the shooter 43 to a desired position beside the snow-remover 10.

A swing drive mechanism 46 adjusts the attitude of the auger housing 44 by swinging the transmission case 32 and the snow-removal working part 40 up and down.

As shown in FIG. 2, the machine body 11 has generator 54 and a battery 55 mounted at its front.

In this way, the snow-remover 10 has on a machine body 11 a snow-removal working part (a working part) 40; an internal combustion engine 34 for driving this working part 40; transporting parts 20L, 20R made up of crawlers or wheels; electric motors 33L, 33R for driving these transporting parts 20L, 20R; a generator 54, driven by the internal combustion engine 34, for supplying electrical power to a battery 55 and the electric motors 33L, 33R; and a control part 56 for controlling the electric motors 33L, 33R. The control part 56 is for example disposed below the control panel 53 or built into the control panel 53.

In the drawings, the reference number 61 denotes a cover covering the engine 34; 62 a lamp; 63 an air cleaner; 64 a carburetor; 65 an engine exhaust muffler; and 66 a fuel tank.

Figure 3:
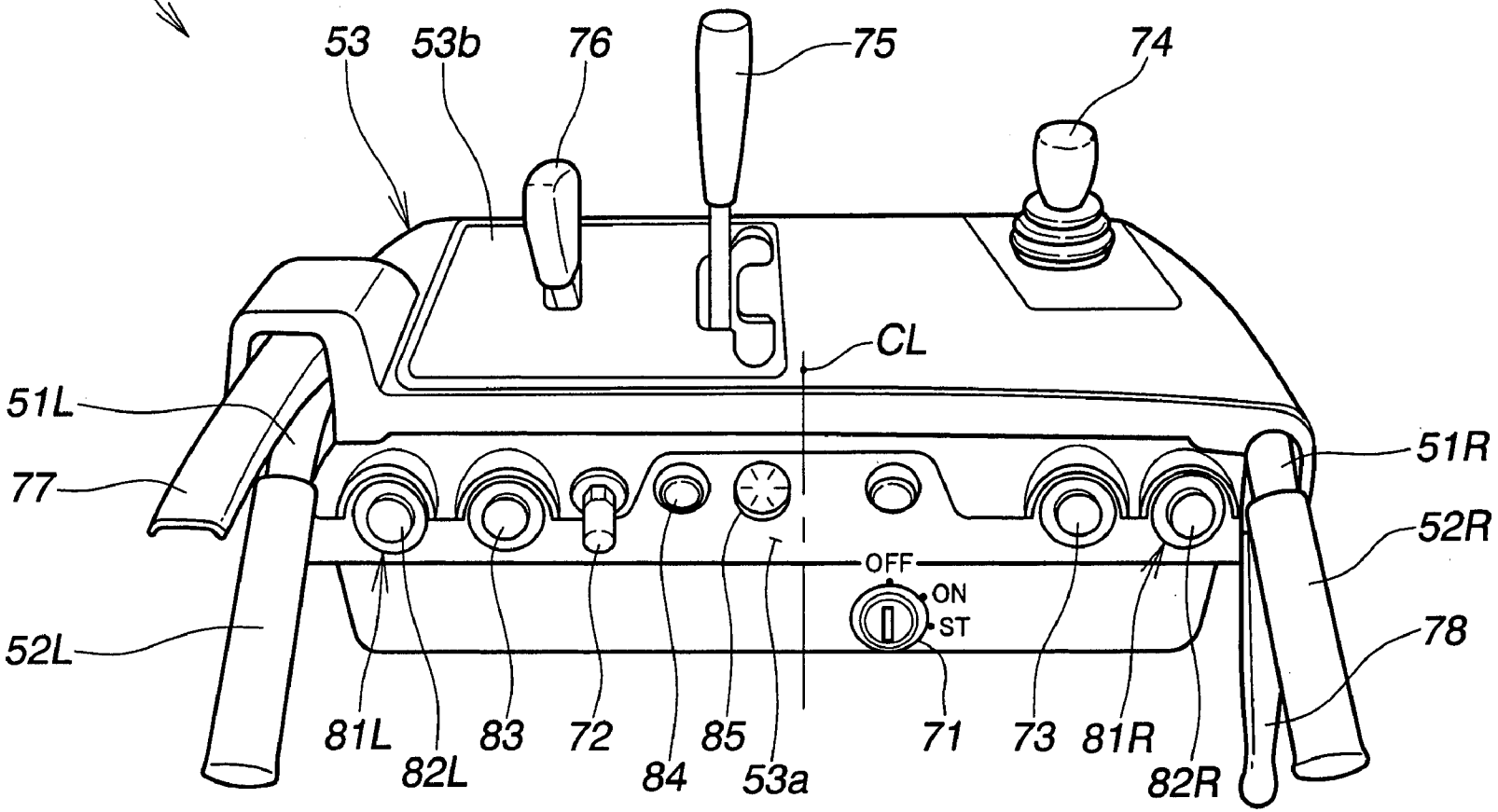
FIG. 3 is a view of a control panel as seen in the direction of the arrow 3 in FIG. 1.

As shown in FIG. 3, the control panel 53 has on a rear face 53*a* thereof (the face facing the operator) a main switch 71, an engine choke 72 and a clutch operating switch 73. On the top face 53*b* of the control panel 53 are provided, in order from the right side to the left side, a snow-throwing direction adjusting lever 74, a direction/speed lever 75 serving as a direction/speed setting member (direction/speed control member) acting on the transporting parts, and an engine throttle lever 76. Also, the grip 52L is disposed to the left of the control panel 53 and the grip 52R is disposed to the right of the control panel 53.

The left operating handle 51L has a locomotion preparation lever 77 near to the grip 52L. The right operating handle 51R has an auger housing attitude adjusting lever 78 near to the grip 52R.

Referring to FIG. 1 and FIG. 3, the main switch 71 is an ordinary ignition switch with which it is possible to start the engine 34 by inserting a main key (not shown) into a key insertion hole and turning it, and for example an off position "OFF", an on position "ON" and a start position "ST" are arranged in this order clockwise around the key insertion hole.

When the main key is turned to the off position OFF, the engine 34 is stopped and the entire electrical system is shut down. When the main key is turned from the off position OFF to the on position ON, the engine 34 is kept in a stopped state. When the main key is turned to the start position ST, the engine 34 is started. When the main key is turned from the start position ST to the on position ON, the started engine 34 shifts to normal running. Thus, the main switch 71 is the electric power supply switch for on/off-controlling the engine 34.

The engine choke 72 is a control member that raises the concentration of the fuel-air mixture when pulled. The clutch operating switch 73 is a push-button switch for turning on and off the auger 41 and the blower 42, that is, a switch for on/off-controlling the snow-removal working part 40. Hereinafter, the clutch operating switch 73 will for convenience be referred to as "the auger switch 73" or "the work switch 73".

The snow-throwing direction adjusting lever 74 is a lever operated to change the direction of the shooter 43.

The direction/speed lever 75 is a forward/reverse speed adjusting lever for controlling the locomotion speed of the electric motors 33L, 33R and switching between forward and reverse by controlling the direction of rotation of the electric motors 33L, 33R.

Figure 4:
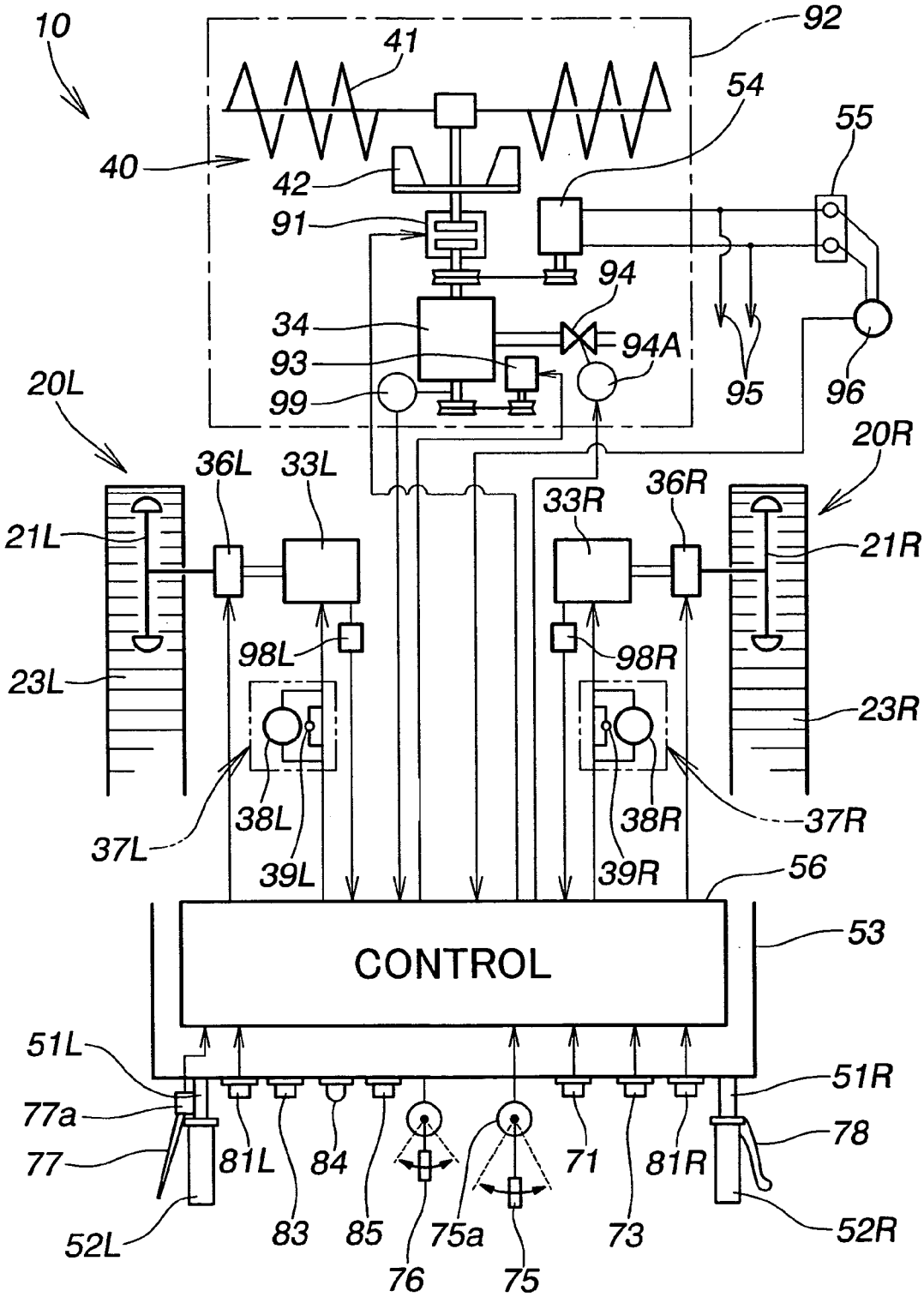
FIG. 4 is a view showing a control system of the snow-remover of FIG. 1.

The engine throttle lever 76 controls the speed of the engine 34 by adjusting the aperture of a throttle valve (see reference number 94 in FIG. 4).

The locomotion preparation lever 77 is a locomotion preparation member that acts on switching means (see reference numeral 77*a* in FIG. 4) and turns the switching means off through the pulling action of a return spring when in the free state shown in the figure. When the left hand of the operator grips the locomotion preparation lever 77 and lowers it toward the grip 52L, the switching means turns on. In this way, the switching means detects whether or not the locomotion preparation lever 77 is being gripped.

The auger housing attitude adjusting lever 78 is a lever operated to control the swing drive mechanism 46 to change the attitude of the auger housing 44.

Also on the control panel 53, between the left and right operating handles 51L, 51R and located so that they can be operated by hands gripping these left and right operating handles 51L, 51R, left and right turn control switches 81L, 81R are provided.

The left turn control switch 81L consists of a push-button switch and has a push-button 82L facing rearward (toward the operator) from the snow-remover 10. This left turn control switch 81L is an automatically returning contact switch that switches on and produces a switch signal only as long as the push-button 82L is being pressed.

The right turn control switch 81R consists of a push-button switch and has a push-button 82R facing rearward (toward the operator) from the snow-remover 10. This right turn control switch 81R is an automatically returning contact switch that switches on and produces a switch signal only as long as the push-button 82R is being pressed.

Specifically, of the rear face 53*a* of the control panel 53, the left turn control switch 81L and its push-button 82L are disposed near the left grip 52L in a position on the machine width center CL side thereof. Within the rear face 53*a* of the control panel 53, the right turn control switch 81R and its push-button 82R are disposed near the right grip 52R toward the machine width center CL.

When the operator grips the left and right operating handles 51L, 51R with both hands, the thumbs of both hands are on the inner sides (the vehicle width center sides) of the operating handles 51L, 51R.

When while gripping the left and right operating handles 51L, 51R with both hands and steering the snow-remover 10, the operator extends the thumb of the left hand forward and pushes the push-button 82L of the left turn control switch 81L while still gripping the operating handles 51L, 51R, for as long as the push-button 82L is pressed the snow-remover 10 turns to the left. And for as long as the operator extends the thumb of the right hand forward and presses the push-button 82R of the right turn control switch 81R, the snow-remover 10 turns to the right.

In this way, without removing the hands from the left and right operating handles 51L, 51R, it is possible to perform a turning maneuver extremely easily with a small operating force.

Because the left and right turn control switches 81L, 81R, which operate regenerative braking circuits (see reference numerals 38L, 38R of FIG. 4) serving as turning mechanisms, are provided between the left and right operating handles 51L, 51R on the control panel 53 and located so that they can be operated by hands gripping these left and right operating handles 51L, 51R, while gripping the left and right operating handles 51L, 51R with both hands and steering the snow-remover 10 (see FIG. 1) the operator can also operate the left and right turn control switches 81L, 81R with thumbs still gripping the operating handles 51L, 51R. Accordingly, it is not necessary to release and grip again the operating handles 51L, 51R or to remove the hands from the operating handles 51L, 51R each time the snow-remover 10 is left-turned or right-turned. Consequently, the steerability of the snow-remover 10 increases.

Also, an idle mode switch 83 and an information display 84 and a sounder 85 serving as indicators are further provided on the rear face 53*a* of the control panel 53.

The idle mode switch 83 is for example a push-button switch that alternately switches on and off every time an operator pushes a push-button. When the push-button is pressed once it switches on and produces and on signal, and when the push-button is pushed again it switches off and produces an off signal.

The information display 84 is a part for displaying information on the basis of a command signal from the control part 56, and for example consists of a liquid crystal display panel or display lights. The sounder 85 is a part for producing a sound on the basis of a command signal from the control part 56, and for example consists of a buzzer for producing a report sound or a speech generator for producing speech.

FIG. 4 is a control diagram of a snow-remover according to the invention. The engine 34, an electromagnetic clutch 91, the auger 41 and the blower 42 constitute a working part system 92, and the rest constitutes a transporting part system.

First, the operation of the snow-removal working part 40 will be described.

When the key is inserted into the main switch 71 and turned to the start position ST shown in FIG. 3, a cell motor (starter) 93 turns and the engine 34 starts.

The engine throttle lever 76 adjusts the aperture of a throttle valve 94 by way of a throttle wire (not shown), and thereby controls the speed of the engine 34.

Also, the valve aperture of the throttle valve 94 is automatically controlled by way of a valve driving part 94A in accordance with a control signal from the control part 56. In the throttle valve 94, the aperture control of the valve driving part 94A takes priority over aperture control with the engine throttle lever 76.

Some of the output of the engine 34 rotates the generator 54, and the electrical power obtained is supplied to the battery 55 and the left and right electric motors 33L, 33R. The remainder of the output of the engine 34 drives the auger 41 and the blower 42 via the electromagnetic clutch 91. Electrical power is supplied to the left and right electric motors 33L, 33R and other electrical components from the generator 54 and the battery 55 via a harness 95. The terminal voltage (open acquisition voltage) of the battery 55 is detected by the voltage sensor 96.

The reference numerals 98L, 98R denote sensors for detecting the speeds (motor speeds; rotational speeds) of the left and right electric motors 33L, 33R. The reference number 99 denotes a sensor for detecting the speed (rotational speed) of the engine 34.

When the locomotion preparation lever 77 is gripped and the clutch operating switch 73 is operated, the electromagnetic clutch 91 is engaged and the auger 41 and the blower 42 are rotated by motive power from the engine 34. When the locomotion preparation lever 77 is released, or when the clutch operating switch 73 is pressed again, the electromagnetic clutch 91 disengages.

Next, the operation of the transporting parts 20L, 20R will be explained.

The snow-remover 10 of this preferred embodiment has left and right electromagnetic brakes 36L, 36R which are equivalent to a vehicle parking brake. Specifically, the motor shafts of the left and right electric motors 33L, 33R are braked by the left and right electromagnetic brakes 36L, 36R. While the snow-remover 10 is parked, these electromagnetic brakes 36L, 36R are in a braking state under the control of the control part 56. The electromagnetic brakes 36L, 36R are released by the procedure explained below.

When the two conditions of the main switch 71 being in its ON position and the locomotion preparation lever 77 being gripped are satisfied, if the direction/speed lever 75 is switched to forward or reverse, the electromagnetic brakes 36L, 36R assume a released (non-braking; OFF) state.

Figure 5:
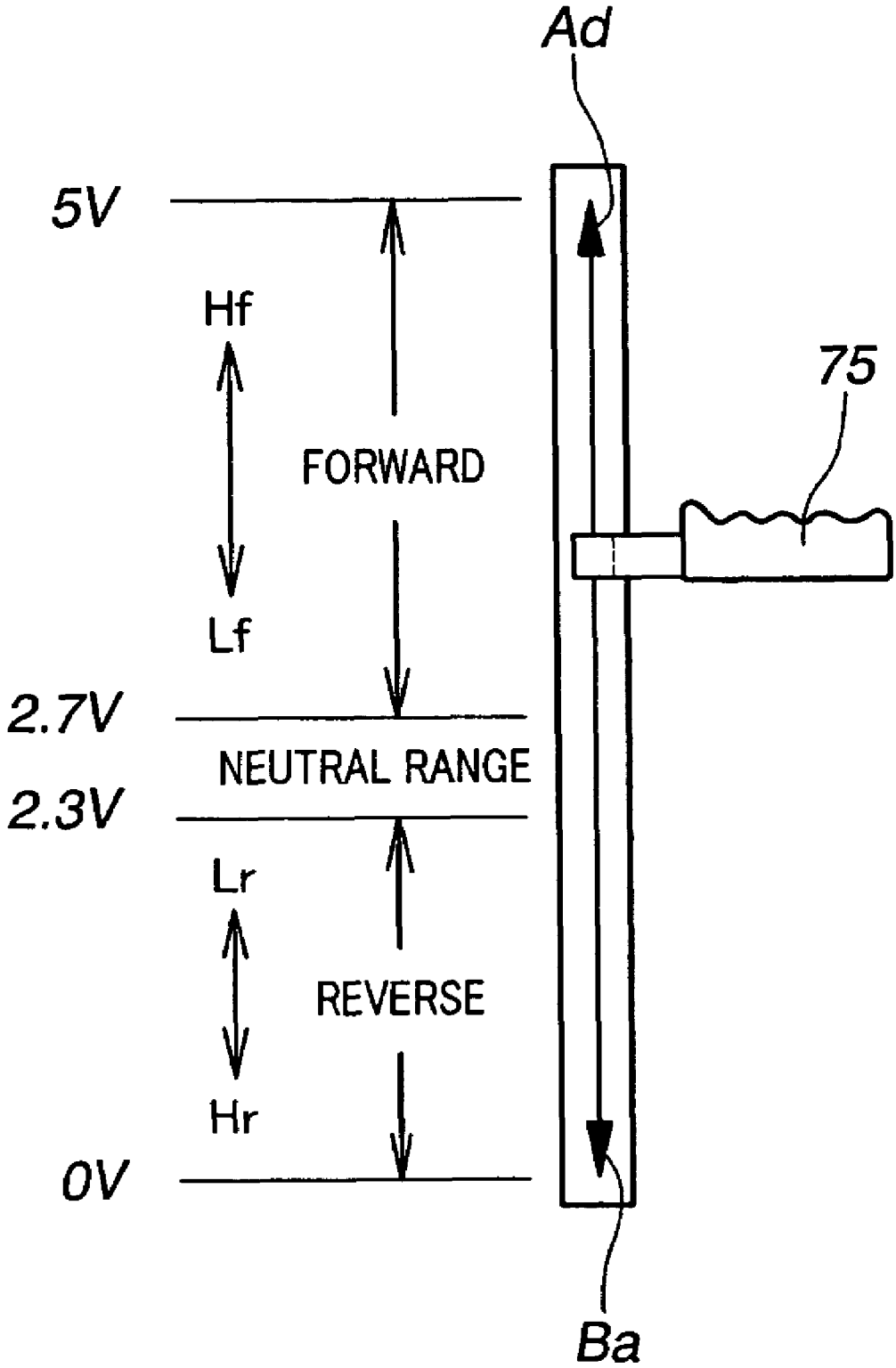
FIG. 5 is a view showing Forward, Reverse and a Neutral Range of a direction/speed lever shown in FIG. 3.

As shown in FIG. 5, the direction/speed lever 75 can move back and forth as shown by the arrows Ad, Ba. If it is shifted from a "Neutral Range" to a "Forward" side, the vehicle moves forward. In the "Forward" region, the speed can be varied so that Lf is low speed forward and Hf is high speed forward. Similarly, if it is shifted from the "Neutral Range" to a "Reverse" side, the vehicle goes in reverse. In the "Reverse" region, the speed can be varied so that Lr is low speed reverse and Hr is high speed reverse. In this preferred embodiment, by a potentiometer 75*a* (see FIG. 4) a voltage corresponding to the position of the direction/speed lever 75 is produced so that the maximum reverse speed is 0V, the maximum forward speed is 5V, and the neutral range is 2.3V to 2.7V, as shown on the left side of FIG. 5. In this way, with the direction/speed lever 75, it is possible to set the forward/reverse direction and perform high/low-speed speed control with a single lever.

As shown in FIG. 4, the control part 56 having obtained information on the position of the direction/speed lever 75 from the potentiometer 75*a* controls the left and right electric motors 33L, 33R via left and right motor drivers 37L, 37R; the speeds of the electric motors 33L, 33R are detected by rotation sensors 98L, 98R, and on the basis of those signals the control part 56 executes feedback control so that the speeds approach predetermined values. As a result, the left and right driving wheels 21L, 21R move in the desired direction at a predetermined speed.

Braking during locomotion is carried out by the following procedure. In this preferred embodiment the motor drivers 37L, 37R include regenerative braking circuits 38L, 38R and short-circuit braking circuits 39L, 39R serving as braking means.

When electrical energy is supplied from the battery to an electric motor, the electric motor rotates. On the other hand, a generator is means for converting rotation into electrical energy. In view of this, in this preferred embodiment, by electrical switching the electric motors 33L, 33R are changed into generators, and caused to generate electricity. If the generated voltage is higher than the battery voltage, the electrical energy can be stored in the battery 55. This is the operating principle of regenerative braking.

When the left turn control switch 81L is being pressed, on the basis of its switch ON signal the control part 56 operates the left regenerative braking circuit 38L and thereby lowers the speed of the left drive motor 33L. When the right turn control switch 81R is being pressed, on the basis of its switch ON signal the control part 56 operates the right regenerative braking circuit 38R and thereby lowers the speed of the right electric motor 33R.

That is, only when the left turn control switch 81L is being pressed does the snow-remover 10 turn to the left, and only when the right turn control switch 81R is being pressed does it turn to the right.

The locomotion of the snow-remover 10 can be stopped by any of the following (1) to (3).

(1) Returning the main switch 71 to its OFF position (2) Returning the direction/speed lever 75 to its neutral position (3) Releasing the locomotion preparation lever 77

This stopping of locomotion is executed using the short-circuit braking circuits 39L and 39R, after electrical speed reduction control, which will be further discussed later, is carried out.

The left short-circuit braking circuit 39L is a circuit for shorting the poles of the left drive motor 33L, and this shorting causes the drive motor 33L to be braked sharply. The right short-circuit braking circuit 39R is the same.

After this stopping of locomotion, if the main switch 71 is returned to its OFF position, the electromagnetic brakes 36L, 36R work, with the same effect as if a parking brake had been applied.

Next, the control operation of the control part 56 shown in FIG. 4 will be described on the basis of the flow charts shown in FIG. 6A through FIG. 6D, with reference also to FIG. 4. This control flow starts for example when the main switch 71 is turned on.

First, referring to FIG. 6A, step (hereinafter abbreviated to ST) 01: Initial setting is carried out.

ST02: Switch signals (including a lever position signal) from the main switch 71, the auger switch 73, the direction/speed lever 75, the switching means 77*a* (locomotion preparation switch 77*a*) of the locomotion preparation lever 77, the left and right turn control switches 81L, 81R and the idle mode switch 83 are read in as input signals.

ST03: The position of the main switch 71, i.e. the switch position of the main key is checked. If it is the "OFF Position", this control is ended. If it is the "START Position", processing proceeds to ST04. If it is the "ON Position", processing proceeds to ST05.

ST04: Because the main switch 71 is in the START position, the engine 34 is started and then processing returns to ST02. That is, the cell motor 93 is driven and an ignition device (not shown) is turned on. After the engine 34 is started like this, the main switch 71 is turned to the "ON Position", and in ST03 it is determined that the main switch 71 is ON and the engine 34 is running.

ST05: The state of the idle mode switch 83 after the engine 34 is started in ST04 is checked. That is, it is checked whether or not the idle mode switch 83 is On. If YES, then it is determined that idle mode control has been selected and processing proceeds to ST07 of FIG. 6B. If NO, then it is determined that the normal control mode has been selected and processing proceeds to ST06.

ST06: Normal locomotion control and work control of the snow-remover 10 is executed and then processing returns to ST02. For example, the control part 56 controls the locomotion of the transporting parts 20L, 20R by controlling the electric motors 33L, 33R and controls the rotation of the working part 40 by controlling the engine 34.

Figure 6A:
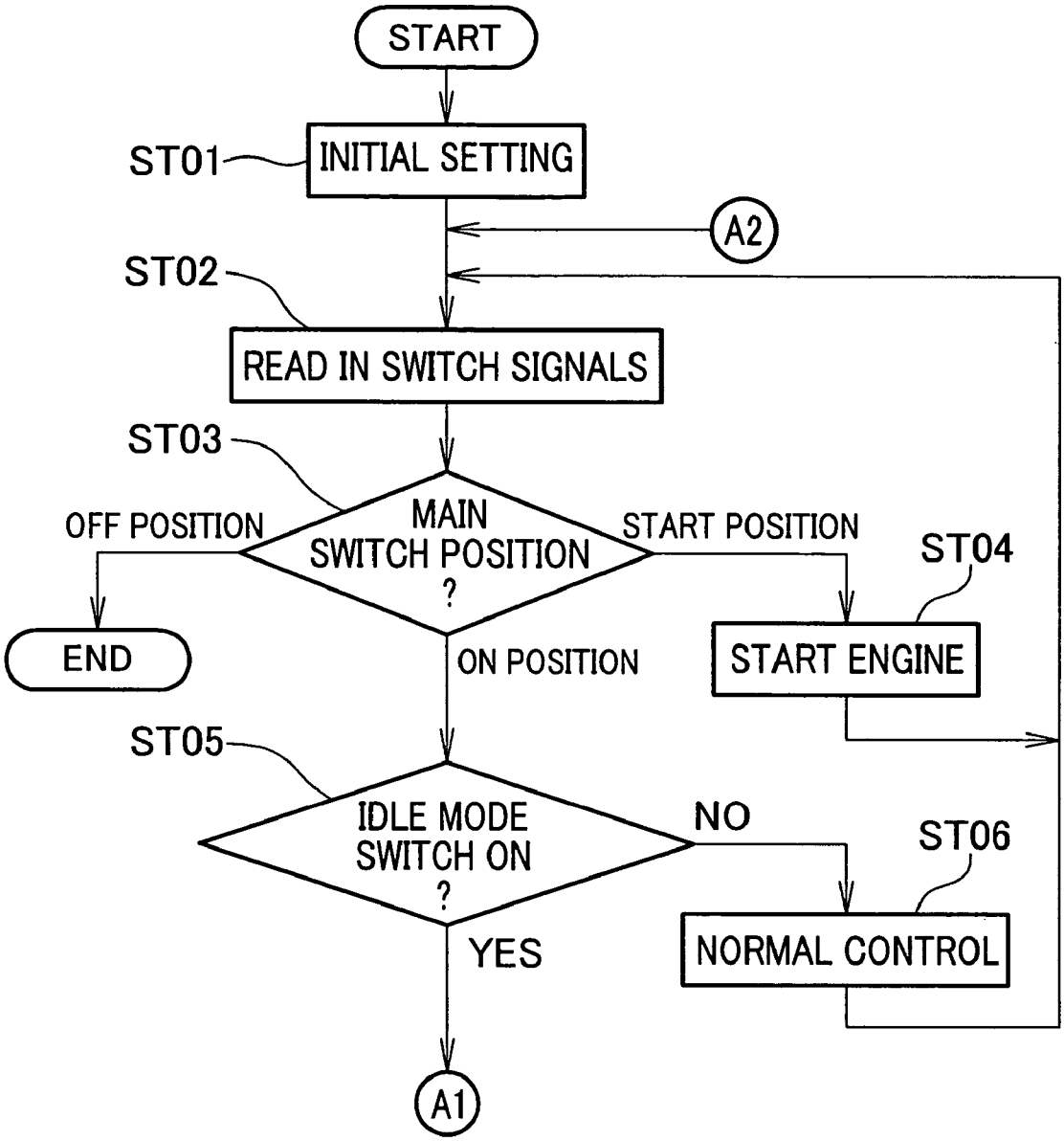
FIGS. 6A-6C are flow charts of a control part according to the invention.
Figure 6B:
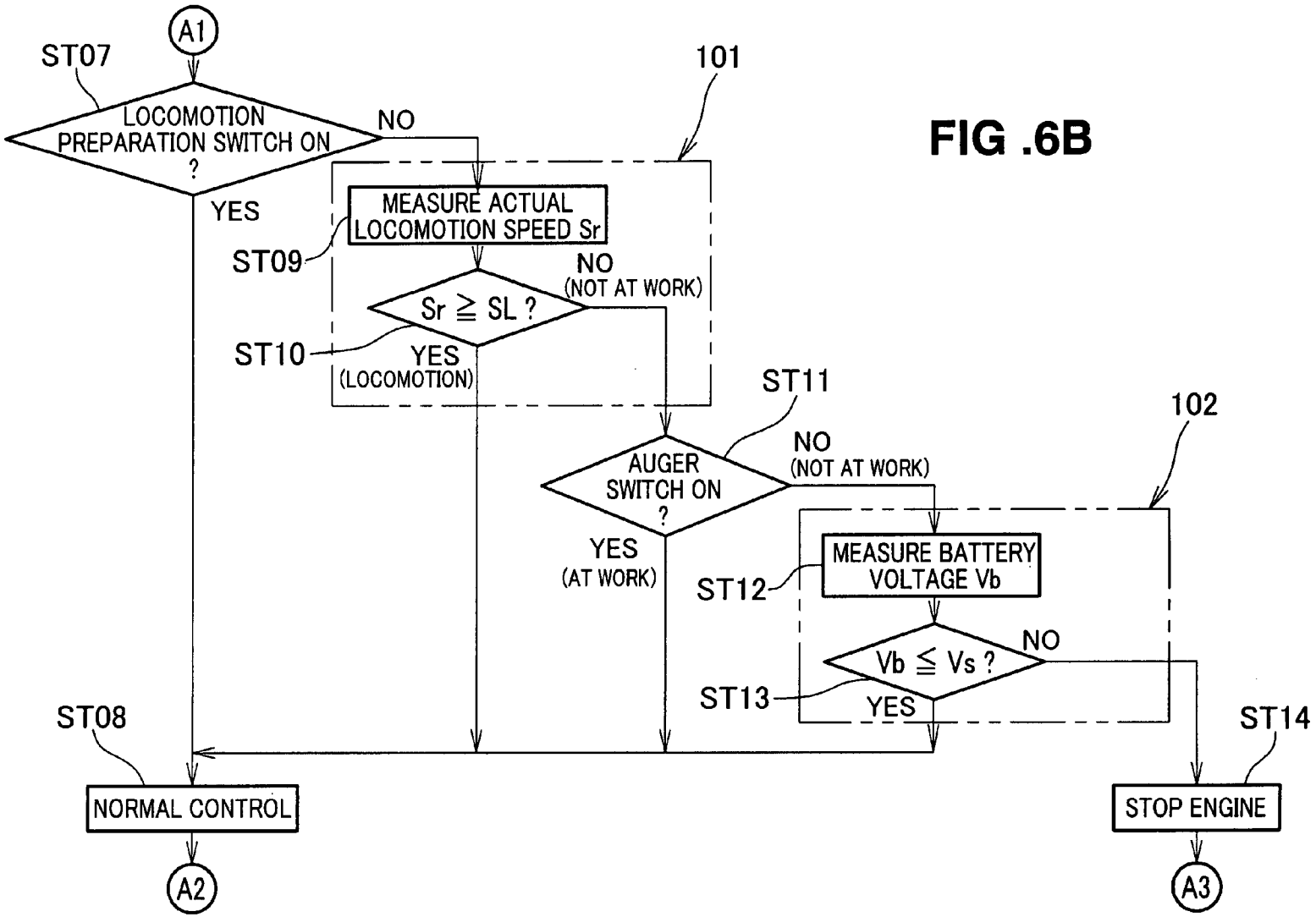

FIG. 6B shows a flow chart for executing predetermined idle mode control.

ST07: It is checked whether or not the locomotion preparation switch 77*a* is On, i.e. whether the locomotion preparation lever 77 has been turned ON. If YES then processing proceeds to ST08, and if No then processing proceeds to ST09. The locomotion preparation switch 77*a* turns On when the locomotion preparation lever 77 is gripped.

ST08: After normal locomotion control and work control of the snow-remover 10 are executed, processing returns to ST02 of FIG. 6A. For example, the control part 56 controls the locomotion of the transporting parts 20L, 20R by controlling the electric motors 33L, 33R and controls the rotation of the working part 40 by controlling the engine 34.

ST09: The actual speed Sr of the transporting parts 20L, 20R is measured. The actual speed Sr can be found by detecting the present speeds of the electric motors 33L, 33R with the rotation sensors 98L, 98R.

ST10: It is checked whether or not the transporting parts 20L, 20R are moving. Specifically, it is checked whether or not the actual speed Sr is equal to or greater than a preset fixed lower limit threshold value SL. If YES, then it is determined that the transporting parts 20L, 20R are moving and processing proceeds to ST08. If NO, then because the actual speed Sr is not as high as the lower limit threshold value SL, it is determined that the transporting parts 20L, 20R have stopped and processing proceeds to ST11.

Here, the lower limit threshold value SL of the locomotion speed is a value serving as a reference for determining that the transporting parts 20L, 20R have stopped, and is a locomotion speed such that the transporting parts 20L, 20R are stopped or are nearly stopped. For example, it is a speed such that the speed of the electric motors 33L, 33R is 0 rpm or nearly 0 rpm (almost stopped).

ST11: It is checked whether or not the auger switch (work switch) 73 is On. If YES then it is determined that the machine is At Work (the working part 40 is On) and processing proceeds to ST08. If NO then it is determined that the auger switch 73 is Off, i.e. the machine is Not At Work (the working part 40 is Off) and processing proceeds to ST12.

ST12: The voltage Vb of the battery 55 is measured. As the voltage Vb the present terminal voltage of the battery 55 is detected.

ST13: It is checked whether or not the voltage Vb is below a preset fixed lower limit threshold value Vs. If YES then processing proceeds to ST08 and normal control is carried out. If NO then it is determined that the voltage Vb is above the lower limit threshold value Vs and processing proceeds to ST 14.

Here, the lower limit threshold value Vs of the battery voltage is a minimum reference voltage such that even after the engine 34 is stopped it is possible for the electric motors 33L, 33R to be driven for a short time by electrical power supplied from the battery 55 and furthermore it is possible for the engine 34 to be restarted using the residual capacity of the battery 55. The residual capacity of a battery is the amount of electricity that can be obtained from the battery when the charged battery is discharged at a fixed current, and generally it is given by the product of the discharge current and the discharge time and the units of Ah (Ampere hours) are used.

ST14: When the main switch 71 is On (in its ON position), i.e. the engine 34 is running, the engine 34 is stopped on condition that the locomotion preparation lever 77 is Off, the transporting parts 20L, 20R are stopped, and the auger switch 73 (the work switch 73) is Off. After this stopping of the engine 34, processing proceeds to ST15 of FIG. 6C.

The stopping of the engine 34 is carried out for example by (1) turning the ignition device off, or (2) temporarily closing a fuel cutoff valve provided in a fuel supply line to the engine 34 and thereby cutting off the fuel supply to the engine 34.

Figure 6C:
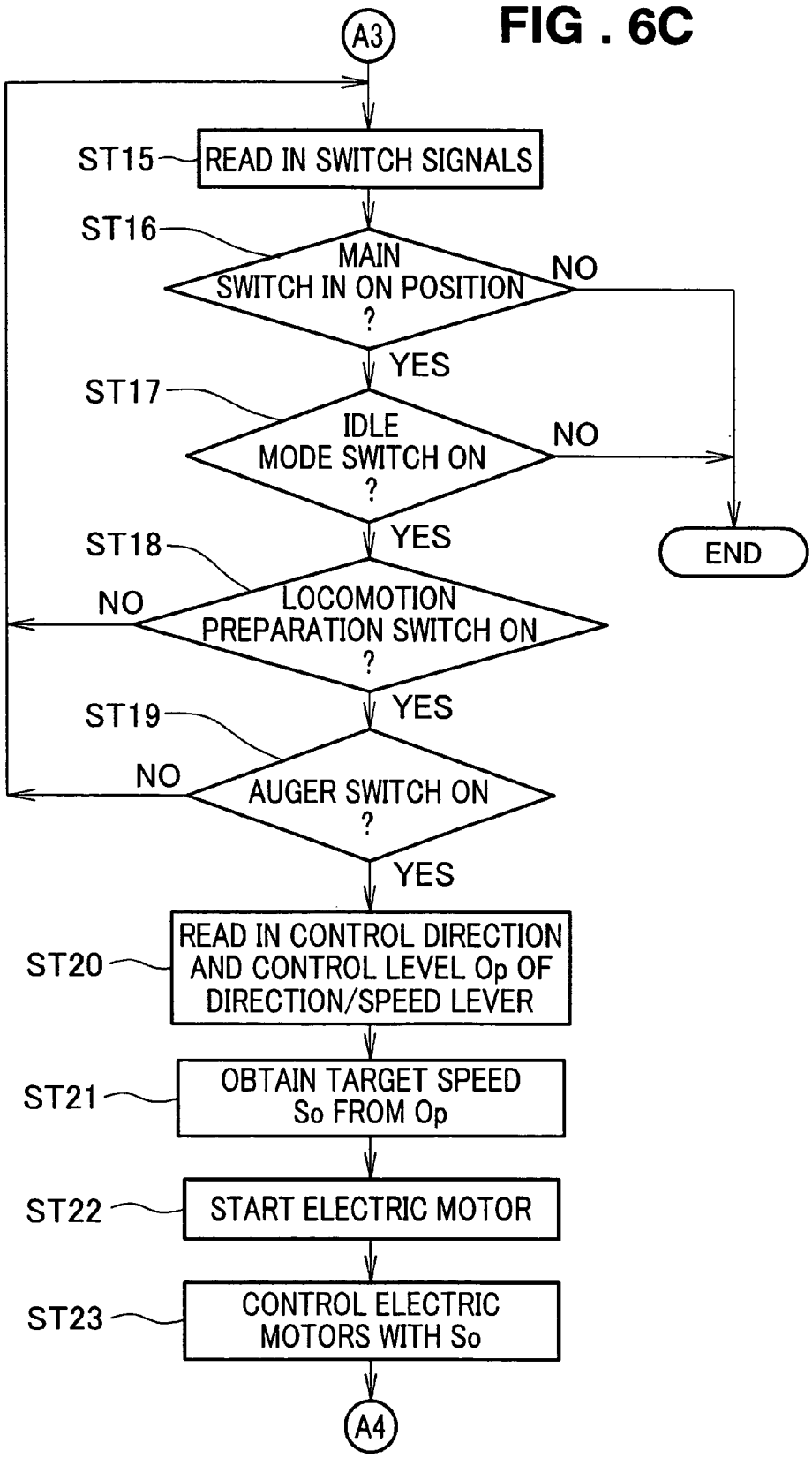

FIG. 6C shows a flow chart for restarting the engine in idle mode control.

In FIG. 6C, ST15: The switch signals (including a lever position signal) from the main switch 71, the auger switch 73, the direction/speed lever 75, the switching means 77*a* (locomotion preparation switch 77*a*) of the locomotion preparation lever 77, the left and right turn control switches 81L, 81R and the idle mode switch 83 are read in as input signals.

ST 16: It is checked whether or not the main switch 71 is On. If YES then processing proceeds to ST17. If NO then this control is ended.

ST17: It is checked whether or not the idle mode switch 83 is On. If YES then processing proceeds to ST18. If No then this control is ended.

ST18: It is checked whether or not the locomotion preparation switch 77*a* is On, i.e. whether the locomotion preparation lever 77 is On. If YES then processing proceeds to ST19. If NO then processing returns to ST15. The switching means 77*a* turns On when the locomotion preparation lever 77 is gripped.

ST19: It is checked whether or not the auger switch 73 is On. If YES then it is determined that the machine is At Work (the working part 40 is On), and processing proceeds to ST20. If NO then it is determined that the auger switch 73 is Off, i.e. the machine is Not At Work (the working part 40 is Off) and processing returns to ST15.

ST20: The control direction and control level Op of the direction/speed lever 75 are read in. These are determined by the position of the direction/speed lever 75.

ST21: A target speed (target locomotion speed) So of the transporting parts 20L, 20R is obtained from the control level Op of the direction/speed lever 75. The target locomotion speed So is for example a target motor speed of the electric motors 33L, 33R.

ST22: The electric motors 33L, 33R are started.

ST23: The electric motors 33L, 33R are controlled to the target speed So. That is, the locomotion direction (forward or reverse) and locomotion speed of the transporting parts 20L, 20R are controlled. After that, processing proceeds to ST24 of FIG. 6D.

Figure 6D:
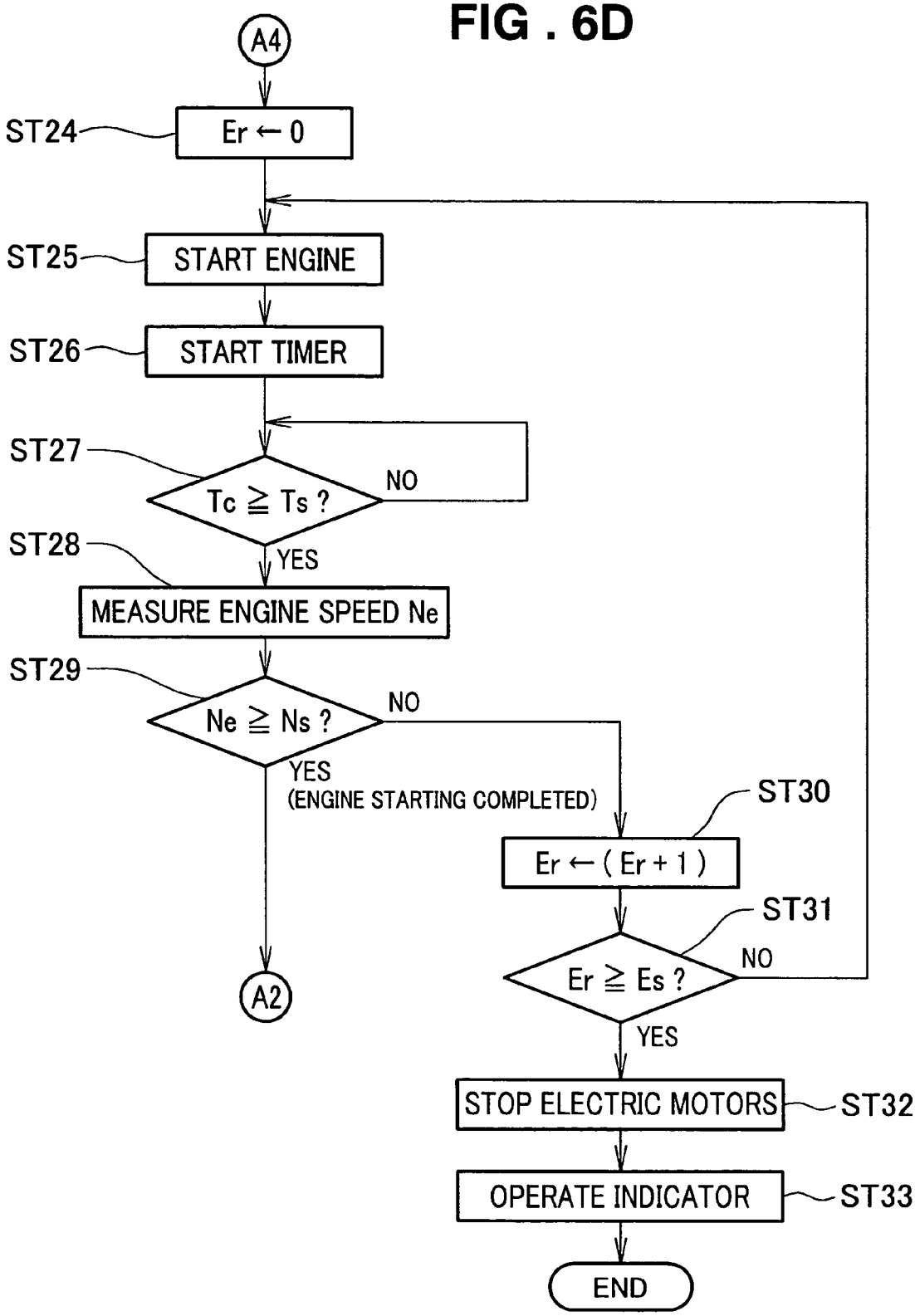

In FIG. 6D, ST24: An actual error count Er is reset to 0.

ST25: The engine 34 is started. That is, the cell motor 93 is driven and the ignition device (not shown) is turned On.

ST26: The count time Tc of a timer built into the control part 56 is reset to 0 and the timer is started.

ST27: It is checked whether or not the count time Tc has passed a preset fixed reference time Ts, and ST27 is repeated until the determination is YES. When the determination has become YES, processing proceeds to ST28. Here, the reference time Ts is the time taken for the engine 34 to reach a stable speed after being started.

ST28: The speed (actual speed of rotation) Ne of the engine 34 is measured. The speed Ne is detected by the rotation sensor 99 detecting the rotation speed of the engine 34.

ST29: It is checked whether or not starting of the engine 34 has completed properly. Specifically, it is checked whether or not the speed Ne of the engine 34 has reached a preset fixed lower limit threshold value (reference speed) Ns. If YES then it is determined that starting of the engine 34 has completed properly and processing returns to ST02 of FIG. 6A. If NO then because the lower limit threshold value Ns has not been reached it is determined that starting of the engine 34 did not complete properly and processing proceeds to ST30.

Here, the lower limit threshold value Ns is a reference speed serving as a reference for determining whether starting of the engine 34 has completed properly.

ST30: Because the engine 34 did not start, the actual error count Er is incremented by 1 (Er=Er+1).

ST31: It is checked whether or not the actual error count Er has reached a preset fixed reference error count Es. If YES then it is determined that an inspection is necessary and processing proceeds to ST32. If NO then processing returns to ST25.

ST32: When the engine 34 has not started even when ST25 to ST31 have been repeated reference error count Es times, the left and right electric motors 33L, 33R are stopped.

ST33: When the engine 34 has not started even when ST25 to ST31 have been repeated reference error count Es times, either the information display 84 or the sounder 85 is operated to report that the engine cannot start, and then this control is ended.

The combination of ST09 and ST10 of FIG. 6B constitutes locomotion stoppage determining means 101 for ascertaining the condition that the left and right transporting parts 20L, 20R have stopped.

The combination of ST12 and ST13 of FIG. 6B constitutes engine restart possibility determining means 102 for ascertaining the condition that the temporarily stopped engine 34 can be restarted.

Figure 7:
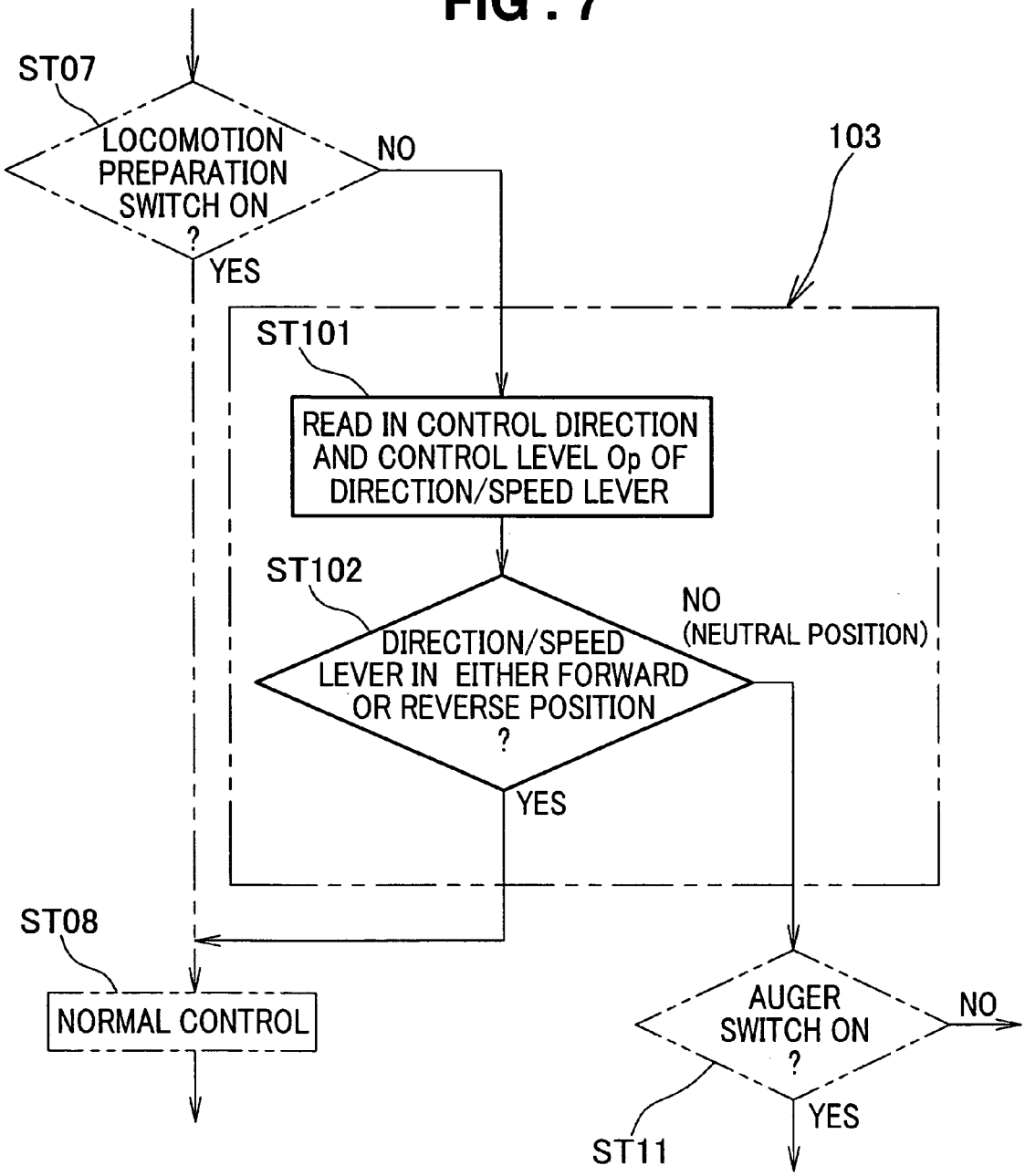
FIG. 7 is a flow chart showing a variation of locomotion stoppage determining means shown in FIG. 6B.
Figure 8:
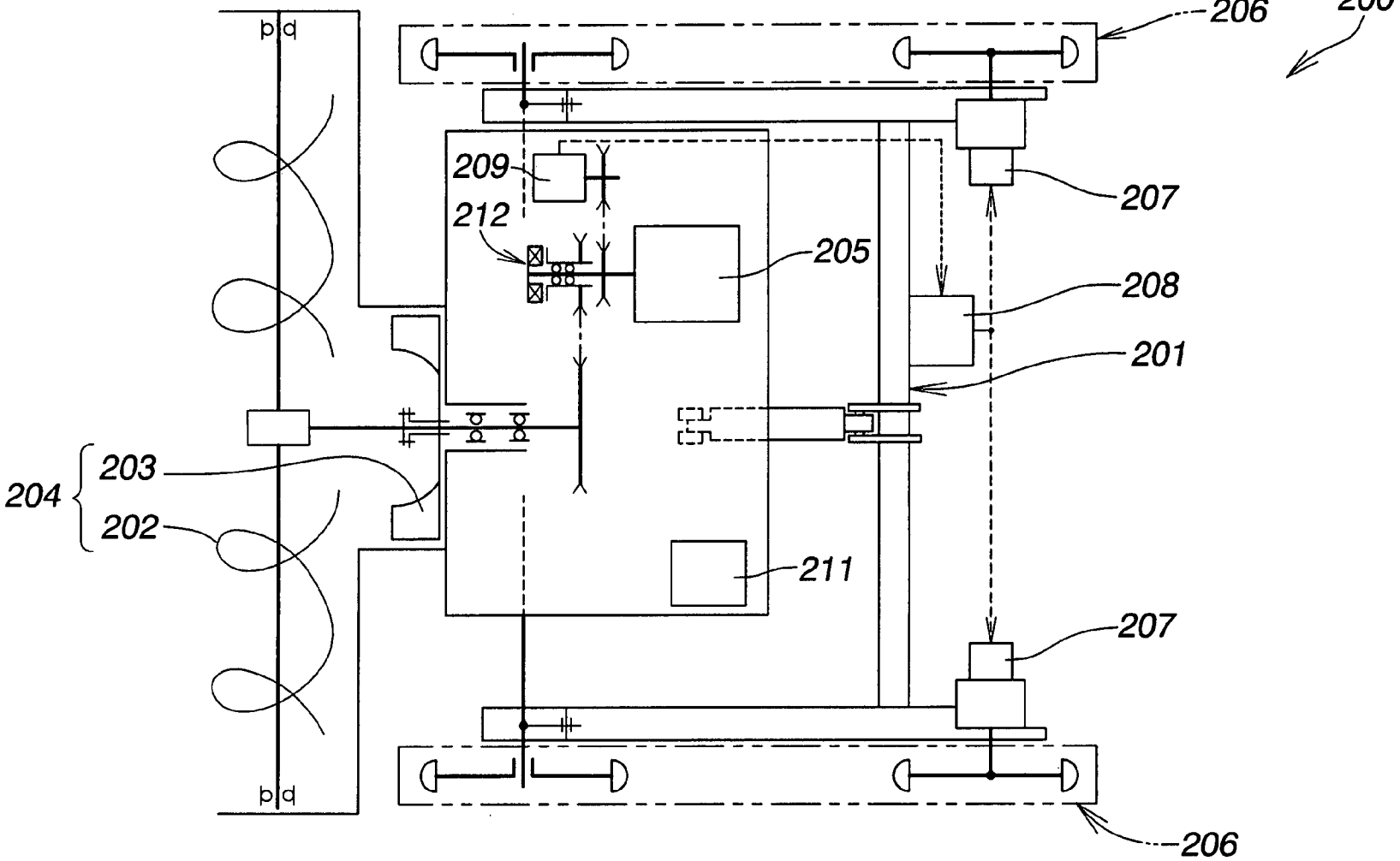
FIG. 8 (PRIOR ART)
FIG. 8 is a schematic view of a snow-remover of the related art.

FIG. 7 shows a variation of the locomotion stoppage determining means 101 shown in FIG. 6B.

This alternative locomotion stoppage determining means 103 is for determining whether or not the target speed (target locomotion speed) ordered by the direction/speed lever (direction/speed setting member) 75 is zero, and is made up of ST101 and ST102. This will now be explained with reference to FIG. 6B.

ST101: When in ST07 the determination was NO (the locomotion preparation switch 77*a* is Off), the control direction and control level Op of the direction/speed lever 75 are read in. These are determined by the position of the direction/speed lever 75.

ST102: It is checked whether or not the direction/speed lever 75 is either in the Forward position or the Reverse position. If YES then processing proceeds to STO8. If NO then it is determined that the direction/speed lever 75 is in the Neutral position (neutral range) and processing proceeds to ST11. When the direction/speed lever 75 is in the Neutral position it is determined that the target locomotion speed ordered by the locomotion speed setting member is 0 (zero).

As described above, in the working machine 10 of this invention, utilizing constituent parts 71, 73, 75 and 77 that are necessary for the working machine anyway, under the conditions that (1) the main switch 71 is On, i.e. the engine 34 is running, (2) the locomotion preparation lever 77 is Off, (3) the transporting parts 20L, 20R are stopped or the actual locomotion speed being ordered by the direction/speed lever 75 is zero, and (4) the work switch 73 is Off, it is determined that the working machine 10 is in a standby state wherein it has stopped locomotion and stopped work, that is, an idling state wherein almost no load is acting on the engine 34, and the engine 34 is automatically stopped.

Thus, necessary constituent parts 71, 73, 75 and 77 of the working machine 10 are utilized effectively to stop the engine 34 automatically by means of a cheap engine stopping system. Also, because it is not necessary for the operator to stop the engine 34 every time work is interrupted, the burden on the operator is lightened. Furthermore, fuel is saved as a result of the engine 34 being made to idle as little as possible. Accordingly, the amount of exhaust produced by the engine 34 is kept down and the working environment is improved, and the life of the engine 34 is extended.

Also, because the operator consciously operates an idle mode switch 83 to select idle mode control, the operator can decide freely whether or not the engine 34 is to be automatically stopped and restarted when idle.

After it has stopped the engine 34, the control part 56 performs control to restart the engine 34 (ST25 of FIG. 6D) when two conditions, a fourth condition that the main switch 71 is On (ST16 of FIG. 6C) and a fifth condition that the locomotion preparation lever 77 is On (ST18 of FIG. 6C) are satisfied.

By control being performed like this, after the engine 34 is automatically stopped, the engine 34 can be restarted just by the locomotion preparation lever 77 being turned On. Therefore, in addition to idling of the engine 34 being minimized, the working machine 10 can be used again quickly, and its operability is improved.

As mentioned above, when conditions for restarting the engine 34 are satisfied (ST15 to ST19 of FIG. 6C), the control part 56 immediately starts the electric motors 33L, 33R (ST22 of FIG. 6C) and at roughly the same time restarts the engine 34 (ST25 of FIG. 6D). The reason for making it perform control in this sequence is that if the electric motors 33L, 33R were to be started while the engine 34 was being restarted, the starting responsiveness of the engine 34 and the electric motors 33L, 33R would be less good.

When the residual capacity of the battery 55 is low, if control is carried out to stop the engine 34, discharging of the battery 55 proceeds while the engine 34 is stopped, and as a result there is a risk of it becoming impossible to restart the engine 34.

With respect to this, if the engine restart possibility determining means 102 is provided, as in this preferred embodiment, the engine 34 can be stopped only when the residual capacity of the battery 55 is above a fixed capacity, and the engine 34 can be restarted easily and certainly.

In the working machine 10, some of the output of the engine 34 drives the generator 54, and the electrical power obtained is supplied to the battery 55 and to the left and right electric motors 33L, 33R. Because it is a so-called hybrid vehicle, it is freely possible to start the electric motors 33L, 33R only, to drive the left and right transporting parts 20L, 20R.

Although in this preferred embodiment a snow-remover has been presented as an example of a working machine 10, the invention is not limited to this and can be applied for example to a mower or a cultivator or some other self-propelled working machine.

As the transporting parts, for example wheels can be used instead of crawlers.

As the direction/speed control member 75, although in this preferred embodiment one direction/speed lever 75 was shown, the functions of this lever may be divided among a plurality of levers, and besides a lever, a dial or a switch or the like may be used. And similarly a dial or a switch may be used instead of a lever for the locomotion preparation member 77 also.

The provision of the idle mode switch 83 and the provision of ST05 of FIG. 6A and ST17 of FIG. 6C are optional.

The engine 34 need only drive the working part 40. However, alternatively a construction may be adopted wherein the engine 34 drives both the working part 40 and the left and right transporting parts 20L, 20R. In this case, the steps ST20 to ST23 of FIG. 6C are dispensed with.

The condition for restarting the engine does not have to be that all the conditions of ST16 to ST19 in FIG. 6C are satisfied. For example, the engine 34 and the electric motors 33L, 33R may alternatively be restarted when only the condition of ST18 of FIG. 6C, i.e., the condition that the locomotion preparation switch 77*a* is On (the locomotion preparation lever 77 is On), is satisfied.

The third condition set forth above as (3), i.e. the condition that "the transporting parts 20L, 20R are stopped OR the target locomotion speed So ordered by the direction/speed setting member 75 is zero" may alternatively be made that BOTH are satisfied.

For example, either the locomotion stoppage determining means 101 (see FIG. 6B) for ascertaining the condition that the transporting parts 20L, 20R are stopped or the locomotion stoppage determining means 103 (see FIG. 7) for ascertaining the condition that the target locomotion speed So ordered by the direction/speed selector member 75 is zero or both may be provided. When both the locomotion stoppage determining means 101 and the locomotion stoppage determining means 103 are provided, both of them can be executed essentially simultaneously by being executed by series processing or by time-allocated processing.

Because, as described above, in a working machine having an engine for driving a working part according to this invention, control is carried out to stop the engine when the engine is idling under certain conditions, besides the snow-remover shown in this preferred embodiment, the invention can also be applied to other working machines having an engine and transporting parts, such as mowers and cultivators and the like.

Obviously, various minor changes and modifications of the present invention are possible in the light of the above teaching. It is therefore to be understood that within the scope of the appended claims the invention may be practiced otherwise than as specifically described.

What is claimed is:

1. A self-propelled working machine, comprising:
- a pair of transporting parts;
- a working part;
- an engine for driving at least the working part;
- a main switch for turning the engine on and off;
- a locomotion preparation switch that produces a command for moving the transporting parts when turned on and that produces a stop command for stopping movement of the transporting parts when turned off;
- a locomotion speed setting member for ordering a target locomotion speed of the transporting parts;
- a work switch for switching on and off the working part; and
- a control part for stopping the engine when a first condition that the main switch is on, a second condition that the locomotion preparation switch is off, a third condition that the transporting parts have stopped moving and the target locomotion speed ordered by the locomotion speed setting member is zero, and a fourth condition that the work switch is off, are satisfied.

2. A self-propelled working machine according to claim 1; wherein the transporting parts are deemed to have stopped moving when the actual speed of the transporting parts is less than a preset fixed lower limit threshold value.

3. A self-propelled working machine according to claim 2; wherein the lower limit threshold value is a value consisting of a locomotion speed such that the transporting parts are stopped or in effect nearly stopped.

4. A self-propelled working machine according to claim 1; further comprising electric motors for supplying motive power to the transporting parts and a battery for supplying electrical power to the electric motors; wherein under the fourth condition the control part performs control to stop the engine when a detected voltage of the battery is greater than a preset lower limit threshold value.

5. A self-propelled working machine according to claim 1; wherein after the control part stops the engine, among the states where the main switch is on, the locomotion preparation switch is on, and the work switch is on, the control part performs control to restart the engine at least when the locomotion preparation switch is turned on.

6. A self-propelled working machine according to claim 1; wherein the transporting parts comprise wheels.

7. A self-propelled working machine according to claim 1; wherein the transporting parts comprise crawlers.

8. A self-propelled working machine according to claim 1; wherein the engine drives the transporting parts.

9. A self-propelled working machine comprising:
- a pair of transporting parts;
- a working part;
- an engine for driving at least the working part;
- a first switch for turning the engine on and off;
- a second switch that produces a command for moving the transporting parts when the second switch is turned on and that produces a stop command for stopping movement of the transporting parts when the second switch is turned off;
- a speed setting member for setting a target speed of the transporting parts;
- a third switch for switching on and off the working part; and
- a control part for stopping the engine when the first switch is on, the second switch is off, the target speed set by the speed setting member is zero, and the third switch is off.

10. A self-propelled working machine according to claim 9; wherein the transporting parts stop moving when an actual speed of the transporting parts is less than a preset fixed lower limit threshold value.

11. A self-propelled working machine according to claim 10; wherein the lower limit threshold value is a speed value such that the transporting parts are stopped or nearly stopped.

12. A self-propelled working machine according to claim 9; further comprising electric motors for supplying motive power to the transporting parts and a battery for supplying electrical power to the electric motors; wherein when the third switch is off, the control part stop the engine when a detected voltage of the battery is greater than a preset lower limit threshold value.

13. A self-propelled working machine according to claim 9; wherein after the control part stops the engine, the control part restarts the engine at least when the second switch is turned on.

14. A self-propelled working machine according to claim 9; wherein the transporting parts comprise one of wheels and crawlers.

15. A self-propelled working machine comprising:
- a pair of transporting parts;
- a working part;
- an engine for driving at least the working part;
- a first switch for turning the engine on and off;
- a second switch that produces a command for moving the transporting parts when the second switch is turned on and that produces a stop command for stopping movement of the transporting parts when the second switch is turned off;
- speed setting means for setting a target speed of the transporting parts;
- a third switch for switching on and off the working part;
- first determining means for determining that the transporting parts have stopped moving; and
- control means for stopping the engine when the conditions of the first switch being on, the second switch being off, the first determining means having determined that the transporting parts have stopped moving, and the third switch being off are satisfied.

16. A self-propelled working machine according to claim 15; further comprising second determining means for determining that the target speed of the transporting parts set by the speed setting means is zero; and wherein the control means stops the engine under the additional condition that the second determining means has determined that the target speed of the transporting parts set by the speed setting means is zero.

17. A self-propelled working machine according to claim 16; further comprising means for executing the first and second determining means simultaneously by series processing or by time-allocated processing.

18. A self-propelled working machine according to claim 15; further comprising electric motors for supplying motive power to the transporting parts and a battery for supplying electrical power to the electric motors; wherein when the third switch is off, the control means stop the engine when a detected voltage of the battery is greater than a preset lower limit threshold value.

19. A self-propelled working machine according to claim 15; wherein after the control means stops the engine, the control means restarts the engine at least when the second switch is turned on.

20. A self-propelled working machine according to claim 15; wherein the transporting parts comprise one of wheels and crawlers.

* * * * *